United States Patent [19]

Popow

[11] 4,199,442

[45] Apr. 22, 1980

[54] RIDDLE WITH LOCKED-IN SCREEN

[76] Inventor: Anatoliy Popow, 6009 S. Rte. 31, Crystal Lake, Ill. 60014

[21] Appl. No.: 881,636

[22] Filed: Feb. 27, 1978

Related U.S. Application Data

[63] Continuation-in-part of Ser. No. 746,368, Dec. 1, 1976, abandoned.

[51] Int. Cl.[2] ..... B07B 1/46

[52] U.S. Cl. ..... 209/408; 209/355

[58] Field of Search ..... 209/355, 315, 403, 408, 209/405; 210/337; 160/383, 392, 395; 264/DIG. 48, DIG. 70; 52/222, 273; 428/35; 156/293, 303.1; 101/127.1–128.4, 415.1

[56] References Cited

U.S. PATENT DOCUMENTS

| | | | |
|---|---|---|---|
| 1,104,773 | 7/1914 | Bradshaw | 210/337 X |
| 1,170,893 | 2/1916 | Graham | 209/355 |
| 2,432,889 | 12/1947 | Herrmann | 160/392 X |
| 2,587,498 | 2/1952 | Marsh | 209/315 X |
| 2,738,914 | 3/1956 | Hatch | 206/519 X |
| 2,879,917 | 3/1959 | Flack | 206/519 X |
| 2,886,481 | 5/1959 | Suan | 186/293 X |
| 3,047,153 | 7/1962 | Zelinski | 209/408 |
| 3,358,879 | 12/1967 | Mueller | 206/519 X |
| 3,374,888 | 3/1968 | Volpert | 209/403 X |
| 3,386,580 | 6/1968 | Grabarczyk | 209/355 X |
| 3,462,328 | 8/1969 | Buckland | 156/293 X |
| 3,503,172 | 3/1970 | Beguin | 52/222 X |
| 3,596,597 | 8/1971 | Fountain | 101/415.1 |

FOREIGN PATENT DOCUMENTS

| | | | |
|---|---|---|---|
| 932644 | 8/1955 | Fed. Rep. of Germany | 209/403 |
| 1015088 | 6/1952 | France | 209/403 |
| 1073869 | 3/1954 | France | 209/403 |

*Primary Examiner*—Robert Halper
*Attorney, Agent, or Firm*—Michael Kovac

[57] ABSTRACT

A riddle is provided with a molded plastic rim having integral upper and lower thickened flanges and a screen with a downwardly extending peripheral edge that is received within a recess in the lower flange and wherein the recess is so configured, arranged and dimensioned to accept cement deposited therein for positively locking the screen to the lower flange of the rim.

1 Claim, 3 Drawing Figures

Fig. 1
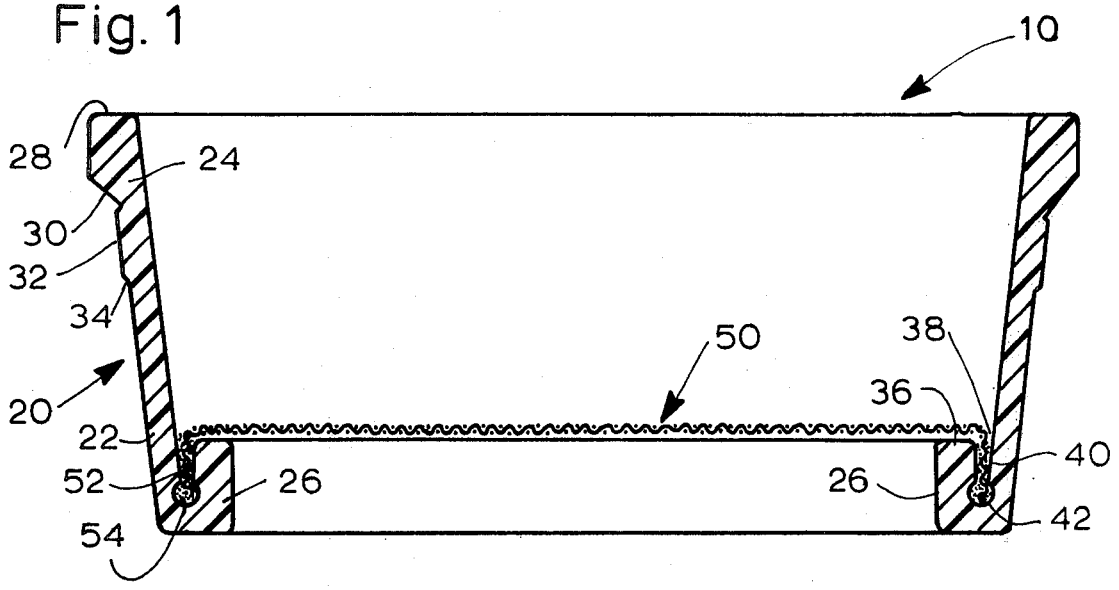
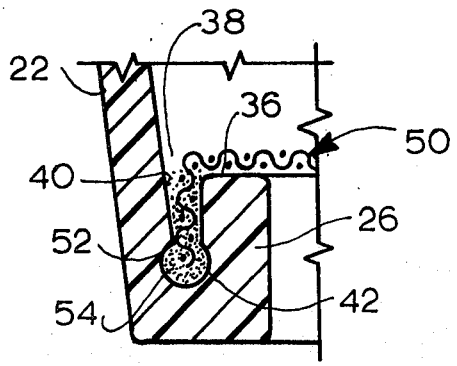
Fig. 2
Fig. 3
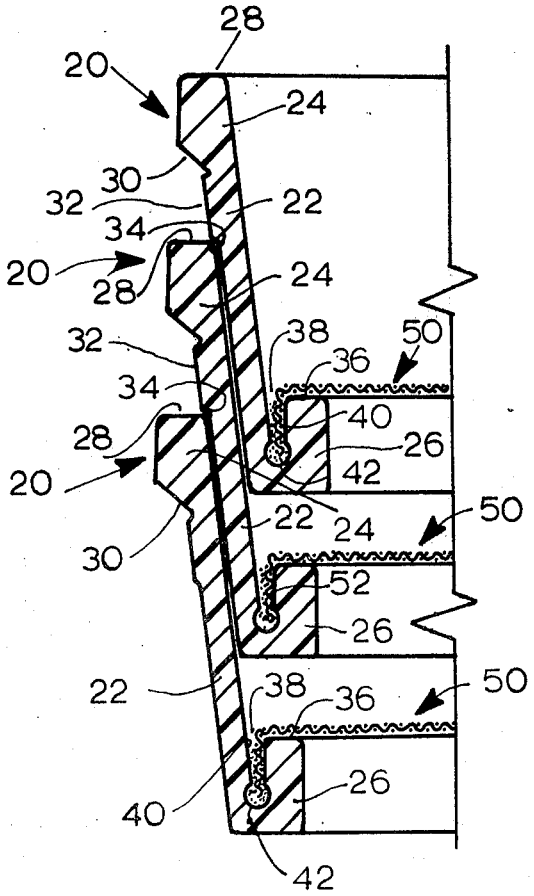

RIDDLE WITH LOCKED-IN SCREEN

SUMMARY OF THE INVENTION

This is a continuation-in-part of my application Ser. No. 746,368 filed Dec. 1, 1976, now abandoned.

A riddle is an open-ended generally cylindrically shaped rim with a screen stretched across one open end. Riddles of this construction are principally used by foundry workmen to sift the molding and core sand in preparing the molds into which molten metal is poured to form castings.

Until the development of the molded plastic riddle shown in U.S. Pat. No. 3,047,153, hand operated riddles of the type described above were made with a wood rim and a metal sifting screen attached thereto. Since riddles were subject to rough usage in foundries, it was found that the wood rim not only wore out quickly, but foundry workmen were subject to wooden slivers and other discomforts in handling the riddles.

The molded plastic riddles shown in the aforementioned patent has overcome the above noted difficulties and had proved to be a commercial success by its more safe, economical, and long-lasting advantages over wooden riddles. Furthermore, molded plastic riddles of the aforementioned type have also been used for a wide variety of sifting and sorting tasks in bakeries, schools and industrial users, and for agricultural purpose.

Due to the extreme rough usage that the molded plastic riddles were subjected to in foundries and during shipment to and storage at foundries and other uses, it was discovered that the sifting screen would sometimes become disengaged from the rim, and/or a plurality of stacked riddles could not be easily separated from each other. The present invention is directed to a riddle construction that overcomes these deficiences.

Accordingly, it is the principle object of the present invention to provide a new and improved riddle that overcomes the deficiences of presently known riddles.

More particularly, it is an object of the present invention to provide a riddle wherein the rim and screen are securely and positively locked to each other.

Another object is to provide a foundry riddle which allows a plurality of riddles to be stacked and separated from each other without sticking.

These and other objects and advantages of the present invention are achieved by the provision of a foundry riddle having a molded plastic rim with upper and lower flanges, at opposite open ends thereof, and a sifting screen connected to the lower flange of the rim by a downwardly extending peripherial edge that is positioned within an upwardly opening recess formed in the lower flange of the desired contour and dimension in order that cement can be deposited within the confines of the recess to positively lock the screen to the lower flange of the rim. Further, a plurality of peripherally spaced stacking ledges for engaging the upper flange on adjacently positioned rims may be provided.

BRIEF DESCRIPTION OF THE DRAWINGS

FIG. 1 is a sectional side elevational view of a riddle which is constructed in accordance with the teaching of the present invention;

FIG. 2 is an enlargement fragmentary sectional view showing the locked-in construction of the screen and rim of the riddle; and FIG. 3 is a fragmentary sectional view of a plurality of adjacently positioned stacked riddles.

DESCRIPTION OF THE PREFERRED EMBODIMENTS

It can be seen in referring to FIGS. 1–3 of the drawings that the riddle 10 comprises a rim 20 and a screen 50. The rim 20 is formed from a durable and strong plastic material such as acrylonitrile—butadiene—styrene copolymer. The Marbon Chemical Division of the Borg-Warner Corporation manufactures such a plastic under the trademark "Cycolac". The screen 40 is preferably formed from metal wire with the appropriate grid or latticework selected for the particular end use of the riddle.

Referring more specifically to the rim 20, it will be noted that the rim 20 has an inverted frusto-conical configuration with an inverted frusto-conical sidewall 22 having at its upper end a thickened and outwardly extending upper annular flange 24 and at its lower end a thickened and inwardly extending lower annular flange 26. The upper flange 24 includes a generally horizontal extending upper surface 28 and a downwardly tapering lower surface 30. The upper surface 28 extends beyond the sidewall 22 for a distance corresponding to the downwardly tapering surface 30 so as to provide a thickened upper flange 24 which affords strength, rigidity and a protruding area which can be grasped by the user.

Immediately below the downwardly tapering lower surface 30 of the upper flange 24 are a plurality of circumferentially spaced stacking ledges 32 which also extend peripherally outwardly from the sidewall 32 by a distance sufficient to cause the lower stacking edge 34 to engage the horizontally extending upper surface 28 on the upper flange 24 of a rim 20 positioned immediately therebelow, as best seen in FIG. 3. The circumferential spacing and height of the stacking ledges 32 are sufficient to stack adjacently positioned rims in a manner to allow air to enter between stacked rims 20 so as to prevent air from being trapped which would create a partial vacuum and cause sticking between stacked rims 20. Thus, whereas in the past there was difficulty due to sidewall wedging of stacked rims 10, this problem has been overcome by the arrangement and position of the stacking ledges 32 in the rims 10. It is to be further noted that when stacked as shown in FIG. 3, there is sufficient axial spacing for the downwardly tapering surface 30 of an upper rim to the horizontally extending surface 28 of a lower rim to allow a user to readily grasp the thickened and protruding upper flanges 24 to remove stacked rims 20 from each other.

Each rim 20 further includes an annular lower flange 26 that extends inwardly within the sidewall 22 so as to thicken the rim 20 along the bottom thereof. The thickened upper and lower flanges 24, 26, are important because the rims 20 are particularly subject to physical abuse along the upper and bottom areas thereof when the riddles 10 are scraped or stuck against metal molding boxes as is the typical practice in a foundry when sand is sifted by riddles 10.

The lower flange 26 includes a lower horizontal shelf 36 into which is formed an upwardly opening annular recess 38 that is located interiorly of the sidewall 22 of the rim 20. The annular recess 38 includes an upper portion 40 that tapers downwardly from the horizontal shelf 36 to a lower portion 42 that has an enlarged ballhead shape. The downwardly tapering portion 40 has a height greater than the diameter of the ballhead shaped opening 42, but the width of the downwardly tapering portion 40 is less than the diameter of the ball-head shaped opening 42. The configuration and dimensioning of the annular recess 38 relative to the screen 50 is important for positively locking the screen 50 to the rim 20, as will now become apparent.

It will be noted that the screen 50 extends across the entire area of the rim 20 at the lower end thereof and rests along its outer periphery on the lower flange 26. Thus, the screen 50 has a flat circular configuration except at its outer periphery where there is a downwardly extending peripheral edge 52 that is configured and dimensioned to be mounted within the downwardly tapering and enlarged ball-head shaped openings 40, 42, respectively of the annular recess 38. More specifically, the configuration and dimensioning of the downwardly tapering portion or opening 42 relative to the downwardly extending peripheral edge 52 of the screen 50 is such as to cause the screen 50 to be mounted within and generally centered relative to the downwardly tapering portion or opening 40 as well as the ball-head shaped opening 42. Accordingly when cement 54, perferably an epoxy resin or the like, is deposited within to generally fill the confines of the annular recess 38, including the downwardly tapered and enlarged ball-head openings 40, 42, respectively, the downwardly extending peripheral edge 52 of the screen 50 is positively and securely locked in generally centered position in the annular recess 38 of the lower flange 26. This structure and arrangement assures positive and equal "locking-in" and equal weight distribution, and therefore, allows for a greater amount of weight or force to be supported by the screen 50 without disengaging the downwardly extending peripheral edge 52 of the screen 50 from the lower flange 26 of the rim 20.

From the foregoing, it will be appreciated that the riddle of the present invention retains all the advantages of prior art riddles including safety, economy and long life while also providing positive locking of the screen to the rim and easy separability of adjacently stacked rims.

I claim:

1. A riddle comprising a molded plastic rim having integral upper and lower flanges, and a sifting screen connected to the lower flange of said rim, said rim being formed in the shape of an inverted frusto-conical configuration with upper and lower ends, said integral upper flange being a solid thickened mass and extending outwardly from said upper end, said integral lower flange also being a solid thickened mass and extending inwardly from said lower end, said lower flange having an annular recess located interiorly of said rim and opening upwardly, said annular recess having a cross-sectional configuration that tapers downwardly on opposite sides thereof to an enlarged ball-head shaped opening which has a diameter exceeding the width of the downwardly tapering portion of said annular recess for at least most of the height thereof, said downwardly tapering portion being generally centrally positioned relative to said enlarged ball-shaped opening and having a height greater than the diameter of the ball-shaped opening, said sifting screen having a flat circular configuration with a downwardly extending peripheral edge that is configured and dimensioned to be mounted within and generally centered relative to the downwardly tapering and enlarged ball-head shaped openings of said annular recess, and cement deposited within and generally filling the confines of the downwardly tapering and enlarged ball-head shaped openings of said annular recess to positively lock said generally centered screen to the lower flange of said rim.

* * * * *